United States Patent [19]

Ewing

[11] 4,352,454

[45] Oct. 5, 1982

[54] WOOD BURNING HEATER

[76] Inventor: James P. Ewing, 447 Tara Rd., Jonesboro, Clayton County, Ga. 30236

[21] Appl. No.: 185,491

[22] Filed: Sep. 9, 1980

[51] Int. Cl.[3] ..... F24D 3/00

[52] U.S. Cl. ..... 237/8 R; 126/101; 126/132; 237/19; 237/55

[58] Field of Search ..... 126/101, 120, 121, 132, 126/133; 237/8 R, 55, 19

[56] References Cited

U.S. PATENT DOCUMENTS

| | | | |
|---|---|---|---|
| 2,703,566 | 3/1955 | Fogel et al. | 126/120 |
| 3,190,279 | 6/1965 | Davis | 126/120 |
| 4,042,160 | 8/1977 | Ickes | 126/121 |
| 4,088,113 | 5/1978 | McIntire | 126/132 |
| 4,136,731 | 1/1979 | DeBoer | 237/55 |
| 4,185,610 | 1/1980 | Buckner | 126/121 |
| 4,224,921 | 9/1980 | Petrescue | 126/120 |

*Primary Examiner*—Ronald C. Capossela

*Attorney, Agent, or Firm*—Newton, Hopkins & Ormsby

[57] ABSTRACT

A sheet metal inner fire box, has a grate, surrounded by refractory border in its bottom portion. Air, from an air intake port, in the front of the stove, passes upwardly through the grate and, thence, out of the discharge flue. An outer jacket houses the fire box and has walls which are spaced by baffles from the walls of the fire box to define an air plenum through which a blower directs the air to be heated. Water coils in the plenum are connected through a pump to the hot water heater.

8 Claims, 4 Drawing Figures

WOOD BURNING HEATER

BACKGROUND OF THE INVENTION

1. Field of the Invention

This invention relates to a wood burning heater and is more particularly concerned with a dual purpose heating system in which a wood burning heater simultaneously heats water for the hot water heater and air which is circulated in a house.

2. Description of the Prior Art

In the past, wood burning heaters have been quite extensively used. A search of the prior art has disclosed the following patents which generally relate to the present invention: U.S. Pat. Nos. 1,370,368; 2,185,665; 2,315,809; 2,192,636; 2,357,831; 2,465,361; 2,516,469; 2,810,380; 2,958,755; 4,025,043; 4,047,515; 4,050,626; and 4,131,231.

Of the above patents, the patent to Critten U.S. Pat. No. 2,810,380 discloses a wood burning hot air furnace. The patent to Dufault U.S. Pat. No. 2,465,361 discloses the use of baffles for flue gas, while the patent to Briggs U.S. Pat. No. 2,192,636 discloses the use of a blower as part of the fuel mixing nozzle for mixing air and fuel. The patents to Scholtzhauer U.S. Pat. No. 1,370,368 and Cleer, Jr. U.S. Pat. No. 3,958,755 disclose the preheating of water for a water heater. The patent to Daniel U.S. Pat. No. 4,047,515 discloses an air blower feeding to the air plenum of a heater and shows generally a rectangular type of stove having a fire box with a grate.

The prior art devices are quite complex and expensive. The present invention is believed to reduce to a minimum the cost of building an efficient wood burning heater.

SUMMARY OF THE INVENTION

Briefly described, the present invention includes a rectangular fire box which is enclosed in a larger rectangular housing or outer jacket. Extending between the fire box and the outer jacket are a plurality of horizontally disposed baffles which form a tortuous air path in a plenum between the fire box and the jacket. A blower mounted at the bottom of the outer jacket supplies air which is directed by the baffles up through the plenum and, thence, out through a front discharge, the front wall of the fire box being inclined so as to provide sufficient unobstructed area through which the heated air passes.

At the front of the fire box and outer jacket is a central access opening which is closed by a hinged access door which permits access to the interior of the fire box.

In the lower portion of the fire box is a grate surrounded thereabove by refracting material such as fire brick, the grate being supported on angle irons in the fire box. Air for combustion is supplied to the fire box through an air intake port, the port having opposed, slideable dampers which vary the effective size of the opening of the port to thereby regulate the rate of burning of the wood on the grate within the fire box. An ash pan is supported on the bottom of the fire box while the entire heater is supported on a base.

Within the front portion of the fire box is a smoke diverter baffle and within the rear portion, a heat and smoke diverter baffle.

In the upper portion of the plenum is a horizontally disposed coil which forms a heat exchanger through which water is circulated by a pump from the pipe of the water heater and, thence, back to the hot water supply pipe of the water and thence back to a hot water heater.

Accordingly, it is an object of the present invention to provide a wood burning heater which is inexpensive to manufacture, durable in structure and efficient in operation.

Another object of the present invention is to provide a wood burning heater which will simultaneously heat the air within a dwelling and provide an auxiliary source of heat for the water of a water heater.

Another object of the present invention is to provide a wood burning heater which will effectively heat air which has passed therethrough without an appreciable pressure drop in the air.

Another object of the present invention is to provide a heater which can be readily and easily charged with wood or coal and from which the ashes may be easily and readily removed.

Another object of the present invention is to provide a wood burning heater in which the air for combustion can be readily and easily controlled to thereby regulate the rate of heating of the heater.

Other objects, features and advantages of the present invention will become apparent from the following description when taken in conjunction with the accompanying drawings wherein like characters of reference designate corresponding parts throughout the several views and wherein:

BRIEF DESCRIPTION OF THE DRAWING

FIG. 3 is a vertical sectional view of the heater shown in FIG. 1; an

DESCRIPTION OF THE PREFERRED EMBODIMENT

Figure 1:
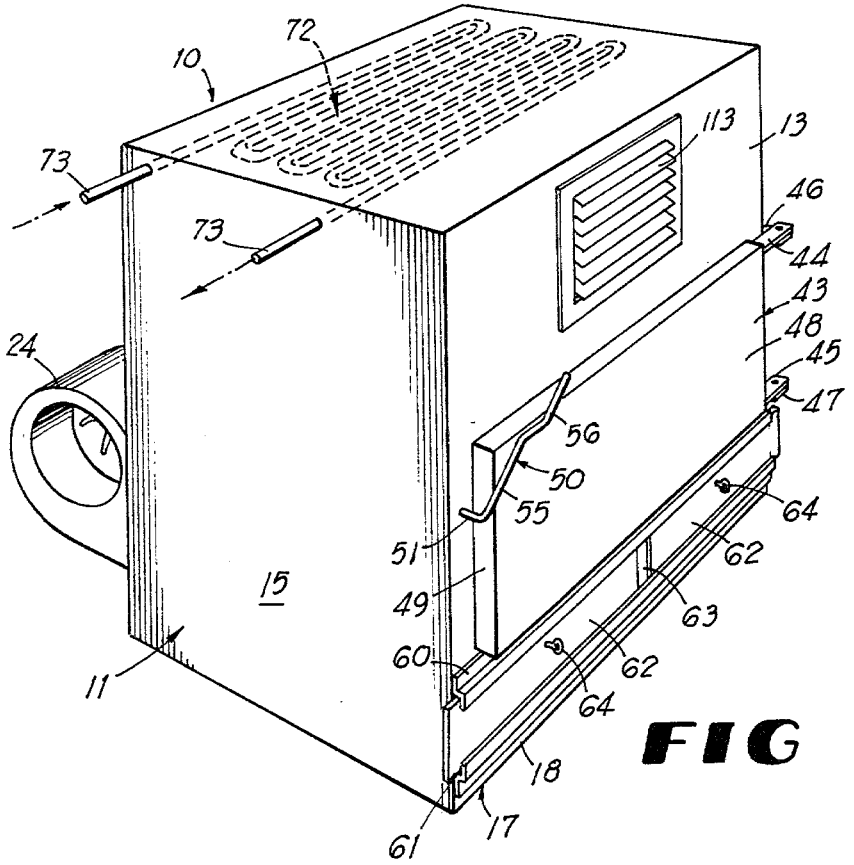
FIG. 1 is a perspective view of a wood burning heater constructed in accordance with the present invention.

Referring now in detail to the embodiment chosen for the purpose of illustrating the present invention, numeral 10 denotes generally the wood burning heater of the present invention, this wood burning heater 10 having an outer jacket or housing, denoted generally by the numeral 11. The outer jacket 11 is formed of sheet metal and includes a flat rectangular sheet metal top panel 12, a rectangular sheet metal front panel 13, a rectangular sheet metal back panel 14 and opposed rectangular sheet metal side panels, such as panel 15. The front panel 13 and the rear panel 14 are in opposed parallel relationship to each other, the upper edge of the front panel 13 being connected to the upper front edge of the top panel 12 and the upper edge of the back panel 14 being connected to the rear edge of the top panel 12. The side panels 15 join the side edges of panels 13 and 14 and connect to the side edges of the top panel 12.

The outer jacket 11 is essentially closed by a bottom panel 16 which extends from the lower edge portions of the panel 14 forwardly to terminate in spaced relationship below the lower edge **13*a* or panel 13. The side edges of bottom panel 16 are secured respectively to the inner surfaces of the side panels 15 to provide, therebelow a skirt 15*a* as an extension of each panel 15. Panel 16 is thus disposed horizontally and parallel to the top panel 12**.

Figure 3:
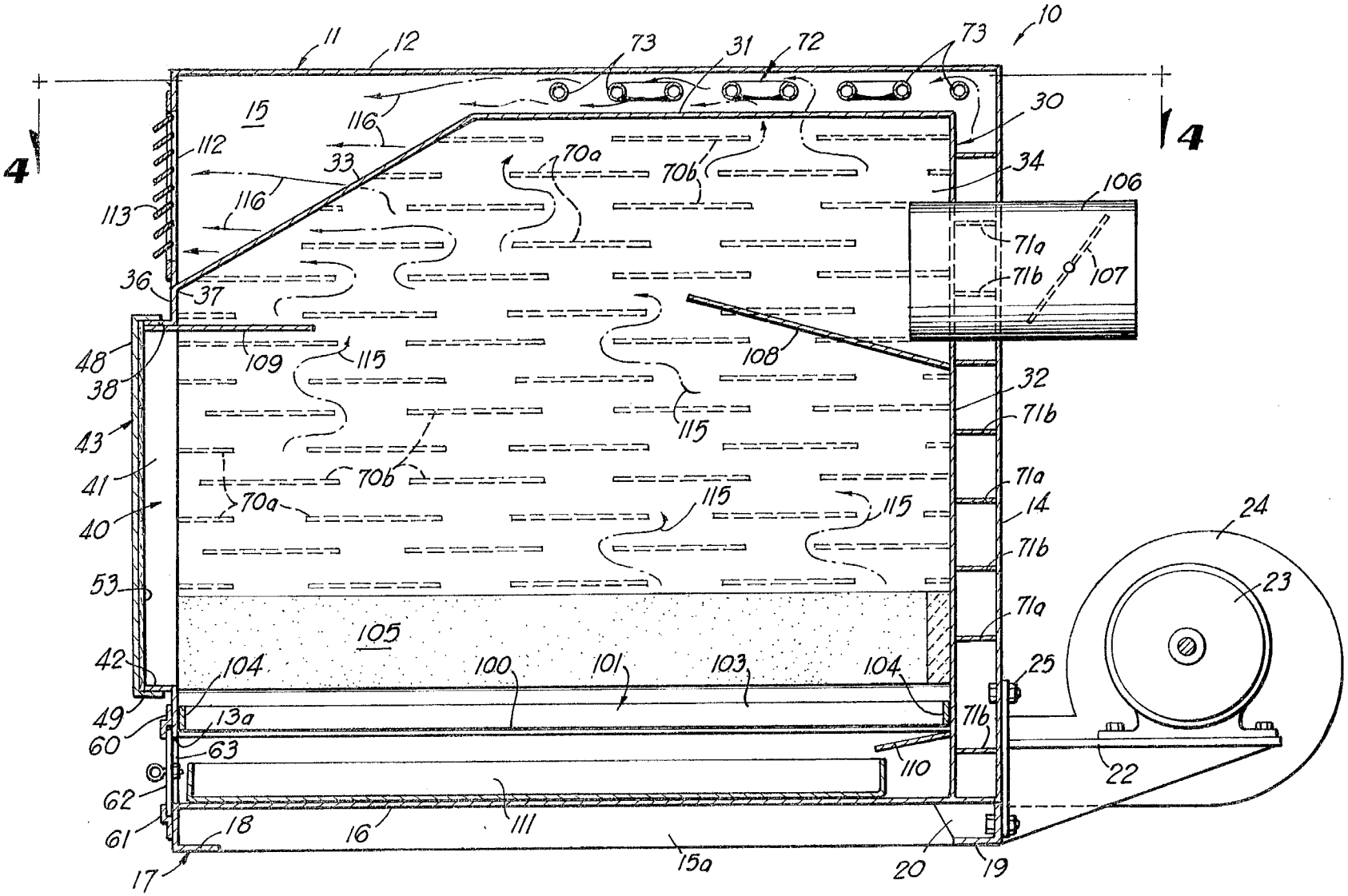

An appropriate base, denoted generally by the numeral 17, supports the outer jacket 11, the base 17 including a front angle iron 18, one flange 18*a* of which is disposed in an upright position parallel to and spaced below the edge 13*a* of front panel 13 and the other flange of which projects inwardly beneath the jacket 11, its outer surface being in a common plane with the lower edge of skirt 15*a*, as illustrated in FIG. 3. A second angle iron 19, having a fillet 20, extends along the rear edge portion of the outer jacket, below and parallel to the rear panel 14 and between the other suitable bases or legs (not shown) can provide support in place of base 17. Fillet 20 is secured to the rear end portion of skirt 15*a*.

Protruding rearwardly from the lower portion of the back panel 14 is a cantilever mounted bracket 22 on which supports a motor 23 which drives a centrifugal blower 24. The discharge end of the blower 24 is secured by bolts 25 passing through the annular flange 26 on the discharge end of the blower 24. These bolts 25 also pass through the back panel 14 so that the blower 24 discharges through an appropriate opening (not shown) in the panel 14.

Figure 4:
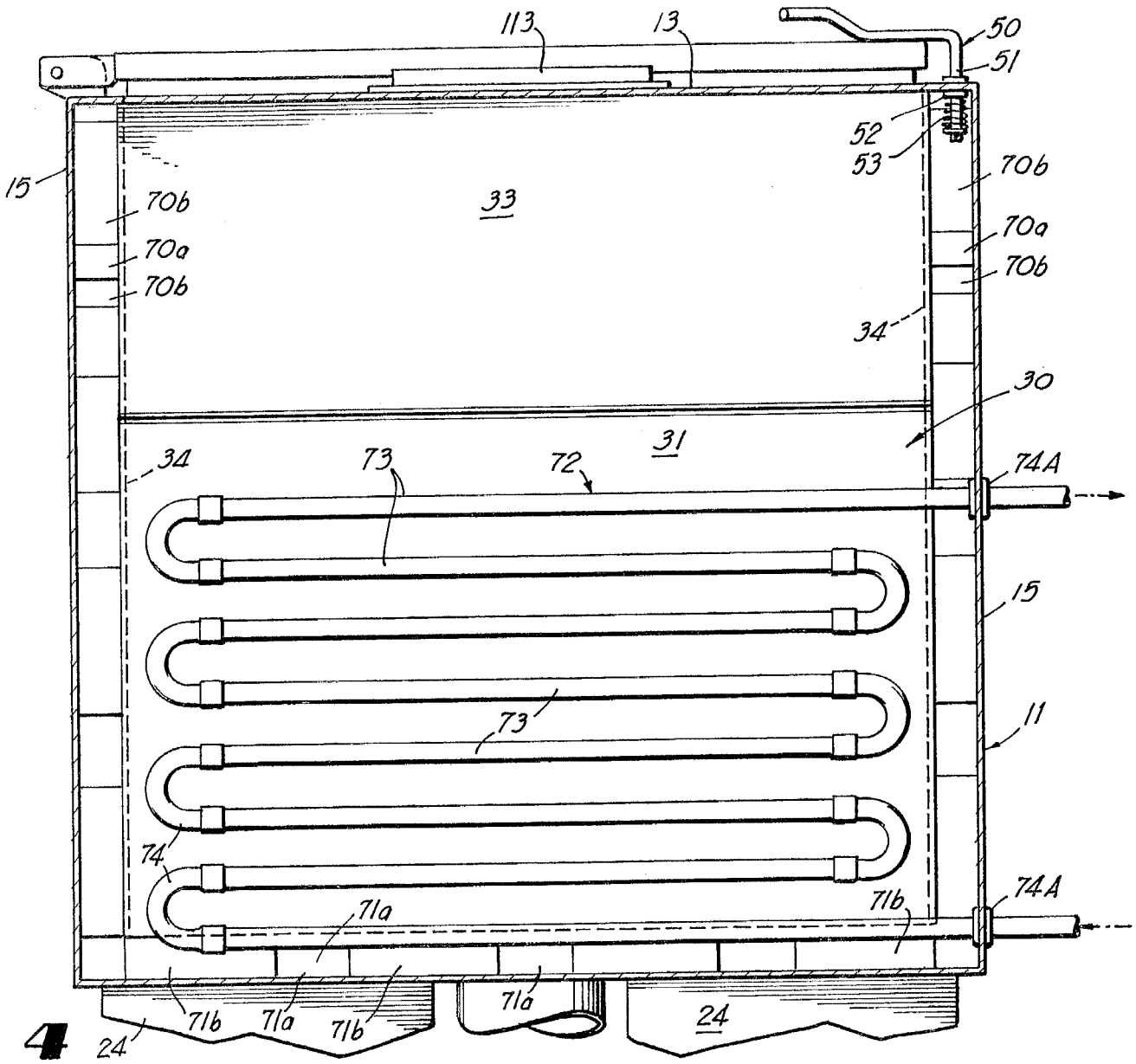
FIG. 4 is a horizontal sectional view taken substantially along line 4—4 in FIG. 3.

Within the outer jacket or housing 11 is a fire box or inner jacket 30, seen in FIGS. 3 and 4. This fire box 30 has a rectangular top panel 31, a rectangular back panel 32, a top inclined panel 33 and a pair of opposed side panels 34. Like the panels 12, 13, 14, 15 and 16, the panels 31, 32, 33 and 34 are sheet metal members of approximately the same thickness as their counterparts in the outer jacket 11. The dimensions of the fire box 30, however, are slightly smaller than the dimensions of the outer jacket 11 and, therefore, the top panel 31 is spaced inwardly of and disposed parallel to the top panel 12. The back panel 32 is spaced inwardly of and disposed parallel to the back panel 14, and the side panels 34 are spaced inwardly of and disposed parallel to the side panels 15.

The lower edge portion of the back panel 32 is mounted appropriately to the upper surface of the bottom panel 16. In like fashion, the side panels 34 are mounted on the bottom panel 16, inwardly of the edges of panel 16.

Preferably, the inclined front panel 33 is formed by the bending of top panel 31 to an obtuse angle so that the forward edge of the top panel 31 and the rear edge of the front panel 33 are joined along a common edge 35, with the front panel 33 extending downwardly and forwardly to terminate at the front panel 13 of the outer jacket 11. A rectangular access opening 40 is cut in the central part of front panel 13. A central flange portion on the forward end portion of the inclined front panel 33 protrudes through this opening 40 and is bent at an obtuse angle to provide a downwardly protruding front plate 36 of about the same width as opening 40, the front plate 36 being secured to the front panel 33 along a common edge 37. The outer portion of the central flange is bent outwardly to provide a flange 38 which forms the top of a rectangular border outwardly protruding or perimetral flange which surrounds the access opening 40. This perimetral flange also includes vertically extending opposed side flanges 41 and a bottom flange 42 which also protrude forwardly from the edges which define the opening 40 in the front panel 13.

A sidewise pivoting access door 43 is provided for closing the access opening 40, this access door 43 being hinged for a swing in a horizontal path about a vertical axis by hinge means which include a pair of vertically spaced sidewise protruding upper and lower brackets 44 and 45 the outer ends of which are pivotally secured to the forward ends of horizontally, forwardly protruding brackets 46 and 47 which are mounted on the outer surface of one of the side panels 15, the brackets 46 and 47 protruding forwardly beyond the outer surface of the panel 13. The access door 43 has a perimetral flange 49 which extends around the periphery of the door panel 48 of door 43. This door panel 48 is also formed of sheet metal. Preferably the inner ends of brackets 44 and 45 are secured to the vertical position of flange 49. Along the inner surface of the door panel 48 is a rectangular gasket 53 which tends to seal the access opening 40 when the access door 43 is closed. When the door 43 is closed, the flange 49 overlies the border formed by flanges 38, 41 and 42.

For maintaining the door in its closed position, a pivotally mounted latch or detent 50 is provided on the front panel 13 so as to pivot over a portion of door 43. As best seen in FIG. 4, the detent 50 is formed of a metal rod bent at a right angle to provide a pivot shaft 51 which is journalled by a sleeve 52 in one side of the front panel 13. A coil spring 54 urges the pivot rod 51 inwardly and retards the full pivoting of the shaft 51. The outer end portion of detent 50 which protrudes perpendicularly to shaft 51 forms a latch bar 55 which, when the detect 50 is appropriately positioned, extends over the upper corner portion of the door 43, as shown in FIG. 1. The outer end portion of latch bar 55 is bent outwardly so as to provide at its outer end a handle 56 which is offset forwardly of the bar 55.

The handle enables the manual manipulation of the detent so as to pivot it about the shaft 51 from a position locking the door in a closed position as shown in FIG. 1 to a position outwardly of the door so that the door can be swung to an open position.

Below the door, the lower edge portion of the front panel 13 is provided with a Z-shaped bracket 60 which extends horizontally across the face of panel 13. Below this Z-shaped bracket 60 is a complimentary Z-shaped bracket which extends across the front angle iron 18, the bracket 60 and 61 being parallel to each other for defining upper and lower races within which are slideably received the opposed rectangular sidewise slideable dampers 62 which regulate the amount of air passing through a rectangular opening 63 formed by the space between the lower edge of the front panel 13 and the upper edge of the angle iron 18. The dampers 62 are rectangular members the length of which is equal to approximately ½ the width of panel 13 and, therefore, when the inner ends of the dampers 62 are brought into engagement, the dampers 62 close opening 63. When, however, the dampers are slid outwardly, they protrude beyond the panels 15 and are spaced from each other along their inner edges so as to provide an effective opening which becomes progressively larger as the dampers 62 are moved outwardly.

Between the outer panels 15 and the inner panels 34 there are provided vertically spaced rows of horizontally spaced baffles 70*a* and 70*b*. Each of the baffles 70*a* in a single row are in a common horizontal plane with their adjacent edges spaced from each other. Each of the baffles 70*b* which are in a single row are in a common horizontal plane spaced from the baffles 70*a* and also offset from these baffles so as to overlap the space between adjacent baffles 70*a*. Such baffles 70*a* and 70*b* are disposed in a multitude of equally vertically spaced rows throughout the height of that portion of the plenum or plenum chamber defined by the opposed flanges 15 and 34. In like fashion there are rows of baffles 71*a* and 71*b* between the walls 14 and 32, as seen in FIG. 3. Like the baffles 70*a* and 70*b*, baffles 71*a* are in a common horizontal plane with their ends spaced from each other and the baffles 71*a* are disposed in common rows alternating between the rows of baffles 71*a*. The opening between adjacent baffles 71*b* are offset from the openings between adjacent baffles 71*a* in their respective rows.

Air delivered to the plenum chamber formed between the outer jacket 11 and the inner jacket or fire box 30 percolates up through the openings in the rows of baffles 70*a*, 70*b*, 71*a* and 71*b* to the upper area of the plenum, accumulating heat from the fire box 30 when the heater is in operation. The air at the top portion of the plenum passes over a water heat exchanger, denoted generally by the numeral 72, this heat exchanger consisting of a plurality of spaced parallel horizontally disposed transversely extending straight pipes or tubes 73, alternate ends of adjacent pairs of such pipes 73 being joined by U-shaped couplings 74. The outer pipes 73 protrude through appropriate grommets 74*a* in one of the side panels 15 and are connected to the water system as will be explained hereinafter. Thus, in FIGS. 1 and 4, the pipes 73 are illustrated as protruding from one side panel 15 while in the schematic diagram, the pipes 73 protrude from the opposite side 15.

Figure 2:
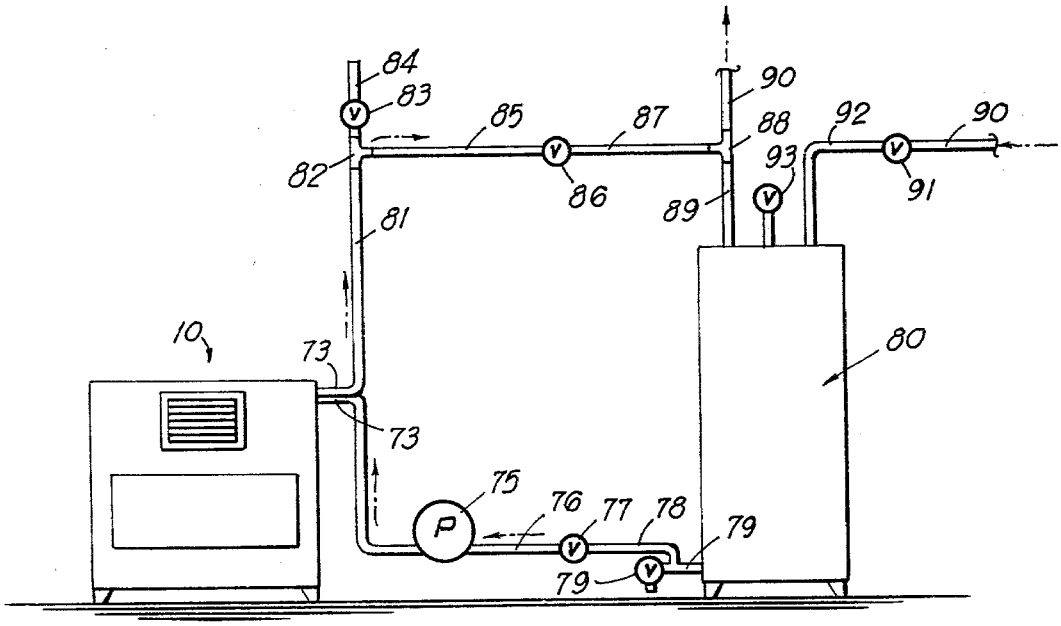
FIG. 2 is a schematic diagram showing the wood burning heater of FIG. 1 connected to a water heater.

Referring now to FIG. 4, in the preferred hook-up of the pipes 73, the intake pipe 73 is connected to the discharge side of a pump 75, the intake or suction side of which is connected by pipe 76, valve 77 and pipe 78 to the drain pipe 79 of a conventional hot water heater 80. The discharge side or pipe 73 of the heat exchanger 72 is connected by pipe 81 to a T-connection 82. One port of the T-connection is connected through a relief valve 83 to a relief pipe 84. The other post is connected through pipe 85, valve 86 and pipe 87 to another T-connection 88, one port of which is connected to the discharge pipe 89 of the water heater 80 and the other is connected to the hot water pipeline 90 which leads to the house. By such an arrangement, when valves 77 and 86 are opened, pump 75 will circulate the water in a closed path between the heater 80 and the heater 10, whereby the water will be heated and the temperature of this heated water reflected in the thermostat which controls the heating element (not shown) of the heater 80. When this thermostat detects that the water is heated to a sufficiently high temperature, it will cause the water heater to shut off, thereby automatically conserving gas or electric heat, as the case may be, which heats heater 80. When pump 75 is shut down, the heater 80 will operate as a conventional heater. Water to the heater is supplied by pipe 90, valve 91 and pipe 92. A relief valve 93 is also illustrated in FIG. 2 for the heater 80.

Referring now to the fire box 30, there are provided a pair of spaced opposed grate supporting member such as angle irons 100 which are secured to the inner surfaces of the walls 34 in a position spaced above the plane of the lower edge 13*a*, these angle irons 100 being parallel to and spaced above the bottom 16. The opposed angle irons 100 extend throughout the length of the firebox, terminating at the panel 13 in the front and the panel 32 in the rear. These angle irons 100 carry, therebetween, a rectangular grate which is of a length substantially equal to the distance between the panels 13 and 32, the grate having spaced parallel bars 103 joined at their ends by transverse end plates 104. Above the angle irons 100, there is provided refractory material 105 which lines the inner surfaces of the panels 32 and 34, as illustrated in FIG. 3. Preferably this refractory material is simply fire brick. The refractory material terminates at the inner surface of panel 13 on opposite sides of the access opening 40.

At the upper central portions of back panels 14 and 32, there is a hollow tubular cylindrical member which protrudes through appropriate openings to terminate in the interior of the firebox. This tubular member forms a discharge flue 106 having a damper 107 therein. The outer end of flue 106 is connected to an appropriate discharge conduit, smokestack or chimney (not shown).

Immediately below the flue 106 is a heat and smoke diverter baffle 108, the baffle being a flat rectangular member the rear end portion of which is secured to the inner surface of panel 132 and the side edges of which are connected respectively to the panels 34. The baffle 108 extends forwardly and upwardly to terminate in the central upper portion of the interior of the firebox, slightly above the lower periphery of the flue 106. Also, a smoke diverter baffle 109 is secured by its forward end portion to the bottom surface of the flange 38 and protrudes inwardly therefrom. This baffle 109, within the fire box extends to the panels 34. The purpose of this baffle is to prevent the smoke which accumulates in the upper portion of the fire box from passing out of the access opening 40 when the door 43 is opened.

At the lower inner corner of the fire box, below the grate 103 is a forwardly and downwardly protruding ash deflector 110. The ash deflector 110 extends across the air intake chamber, below the grate 103 so as to direct the ash which drops through the grate 103 forwardly so that it drops into an ash tray 111 which is slidably received on the bottom plate or panel 16. This ash tray 111 is a rectangular member which is approximately as wide as the distance between the walls 34. The ash tray 111 can be readily removed for periodic dumping when the dampers 62 are moved apart by a maximum distance.

Above the access door 43, the panel is provided with a rectangular air discharge opening 112 over which is mounted louvers 113.

OPERATION

In operation, wood is charged into the interior of the fire box 30 so that it falls down upon the grate 101. The dampers 62 are manipulated so as to permit air to pass into the air chamber below grate 101 and thence up through the openings in the grate 101 so as to supply sufficient air for combustion of the wood which is received on the grate 101. The damper 107 is also manipulated so as to permit smoke to pass out of the flue 106. When the wood is ignited, the heat generated from this wood will heat the walls or panels 31, 32 and 34 so as to heat the air in the plenum chamber. Motor 23 when actuated, will cause the blower 24 to introduce air into the bottom gear portion of this plenum chamber so that the air passes along the paths indicated by the arrows 115 and 116 and out of the discharge port 112 in the upper portion of panel 13 and thence through the open louvers 113 which are disposed over this port 112.

It will be understood that, if desired, the port 112 can communicate with suitable ducts for transferring the air throughout a home.

As the air is fed through the plenum chamber, it follows a sinusoidal path denoted by the numeral 115 and thence forwardly as indicated by the arrows 116. The smoke and products of combustion which accumulate in the upper portion of the interior of the fire box, pass out of the flue 106.

It will be obvious to those skilled in the art that many variations may be made in the embodiment here chosen for the purpose of illustrating the present invention wihtout departing from the scope thereof as defined by the appended claims.

I claim:

1. A heater comprising an outer jacket, a fire box within said outer jacket, a common horizontal bottom panel for said jacket and said firebox said outer jacket and said fire box defining a plenum chamber therebetween, a plurality of horizontal rows of baffles spaced above and generally parallel to said base panel and within said plenum chamber, each of said baffles extending across said plenum chamber and being secured on opposite edges respectively to said jacket and said fire box, said baffles being disposed in vertically spaced rows, the ends of said baffles in each row being spaced from each other for defining a tortous air path through said plenum chamber, means for introducing air into said plenum chamber at the bottom rear portion thereof, said outer jacket being provided with port means at its top portion through which the air from said plenum chamber is discharged, a grate extending across the lower portion of said fire box, said grate being supported by its edges in spaced relationship above said bottom panel by said fire box said grate extending entirely across the bottom portion of the fire box, means for introducing air to the lower side of said grate, a flue extending through the rear portions of said outer jacket and said fire box for communicating with the upper portion of said fire box, said fire box being provided with an access opening and an access door for closing said access opening.

2. The heater defined in claim 1 wherein said outer jacket includes a flat rectangular top panel, a front panel, a back panel and opposed side panels joining the edges of said front panel and said back panel, said side panels being joined to the edges of said top panel and said bottom panel, said fire box having a rear panel and side panels disposed respectively parallel to and spaced inwardly of the rear panel and said side panels of said outer jacket, said fire box also including a front panel connected by its inner edge to the front edge of said top panel, said front panel extending angularly downwardly and forwardly and being connected to said front panel of said outer jacket and a baffle across said fire box and extending fowardly from said rear panel of said fire box below the inner end of said flue.

3. The heater defined in claim 2 wherein said front panel of said outer jacket is provided with a rectangular opening and including a flange protruding through said opening, the inner end of said flange being connected to the outer edge of said front panel of said fire box and additional flanges connected to the aforesaid flange to form a perimeter around said access opening, said flanges extending forwardly of the outer surface of said front panel of said jacket, said access door having a perimetral flange around its edges, said perimetral flange overlapping the flanges defining said access opening when said door is closed, and a handle for latching said door in its closed position.

4. The heater defined in claim 3 wherein said door includes a pair of sidewise extending vertically spaced brackets connected by their inner ends to said perimetral flange, additional brackets connected to one of said side flanges, said additional brackets extending forwardly beyond the outer surface of said front panel of said jacket and pivot means joining the brackets connected to said access door and the brackets connected to said side panel of said jacket for pivoting about a vertical axis.

5. The heater defined in claim 1 including a pair of opposed angle irons mounted respectively on the side panels of said fire box and disposed in opposed horizontal relationship to each other in the lower portion of said fire box, said grate resting upon the flanges of said angle irons.

6. The heater defined in claim 5 wherein the lower edge of said front panel of said jacket is spaced above the lower edges of said side panels, and including a transverse bar extending across the corner post between the corner portions of said side panels, said bar defining with the lower edge of said front panel of said jacket an opening through which air can be introduced to said grate, and wherein said means for introducing air to said grate includes an opening, slidable dampers supported in opposed horizontal relationship to each other for sliding movement toward and away from each other for varying the effective size of said opening being formed between said lower edge of said front panel of said jacket and said bar.

7. The heater defined in claim 1 including a plurality of spaced horizontally disposed transversely extending heat exchanger pipes, U-shaped members connecting the ends of said pipes, and means for introducing water to be heated through said pipes, and means for introducing water to be heated through said pipes, said pipes being disposed in said plenum between the top portion of said jacket and the top portion of said file box.

8. The heater defined in claim 1 including a pump exteriorally of said heater, pipe means connecting the suction side of said pump to the drain of a water heater, a pipe connecting the discharge end of said pump to one of said pipes of said plenum, the other said pipes being connected to the discharge pipe of said water heater for circulating water heated by the pipes in said plenum to the water heater.

* * * * *